US007484973B2

(12) United States Patent
Westhoff

(10) Patent No.: US 7,484,973 B2
(45) Date of Patent: Feb. 3, 2009

(54) WEATHER-RESISTANT ELECTRICAL OUTLET COVER

(76) Inventor: Walter W. Westhoff, 3737 E. Virginia Beach Blvd., Norfolk, VA (US) 23502

( * ) Notice: Subject to any disclaimer, the term of this patent is extended or adjusted under 35 U.S.C. 154(b) by 0 days.

(21) Appl. No.: 11/541,709

(22) Filed: Oct. 2, 2006

(65) Prior Publication Data

US 2008/0081496 A1 Apr. 3, 2008

(51) Int. Cl.
*H01R 13/44* (2006.01)

(52) U.S. Cl. ..... 439/147

(58) Field of Classification Search ..... 439/147, 439/272, 536, 426, 145, 137, 365; 174/66–67
See application file for complete search history.

(56) References Cited

U.S. PATENT DOCUMENTS

| | | | | |
|---|---|---|---|---|
| 4,109,095 | A | 8/1978 | Kling et al. | |
| 4,424,407 | A | 1/1984 | Barbic | |
| 4,484,021 | A | 11/1984 | Schaefer et al. | |
| 5,017,153 | A * | 5/1991 | Bowman | 439/426 |
| 5,078,614 | A | 1/1992 | Shotey | |
| 5,317,108 | A | 5/1994 | Prairie, Jr. | |
| 5,342,995 | A * | 8/1994 | Comerci et al. | 174/67 |
| 6,148,742 | A * | 11/2000 | Constable et al. | 110/250 |
| 6,537,089 | B1 * | 3/2003 | Montague | 439/145 |
| 6,982,381 | B1 | 1/2006 | Backofen et al. | |
| 7,094,080 | B2 | 8/2006 | Dickie et al. | |
| 7,097,474 | B1 | 8/2006 | Naylor | |

* cited by examiner

*Primary Examiner*—Edwin A. Leon
(74) *Attorney, Agent, or Firm*—Stephen Clark

(57) ABSTRACT

A weather-resistant cover for an electrical connection box is constructed of a resilient elastomeric material. In a preferred embodiment of the invention, the elastomeric cover is immovably sandwiched between an outlet face plate and an electrical receptacle and the box to which the receptacle is secured. The cover prevents moisture and airborne particles from getting into the connection box. Self-closing slots cut into the elastomeric cover are in alignment with the prong opening in the electrical receptacle. An electric plug may be plugged into the receptacle by inserting the plug's prongs through the slots in the cover and into the receptacle. When an electric appliance is plugged into the device, a seal is formed between the face of the plug and the elastomeric cover. When the plug is removed, the slots in the cover automatically close due to the elastic memory of the resilient material of which the cover is made. In a modified embodiment of the invention, the cover and face plate are molded into a unitary structure, which can be attached directly to the face of the electrical connection box by screws (or the like). In other modifications of the invention, a modified weather-resistant cover is used in conjunction with electrical connection boxes other than outlet boxes.

2 Claims, 7 Drawing Sheets

WEATHER-RESISTANT ELECTRICAL OUTLET COVER

BACKGROUND OF THE INVENTION

1. Field of the Invention

The present invention relates to boxes and housings for electrical devices. More particularly, the present invention relates weather-resistant electrical enclosures.

2. Description of the Prior Art

Conventional electrical boxes used as connection boxes, receptacle boxes and switch boxes are typically constructed with little or no protection against the entry of moisture, dust, particles, rain and direct impingement of water. The primary purpose of the standard enclosure is to prevent inadvertent contact with the body, tools or other objects that would cause damage or a safety hazard. In a clean, dry environment this would normally not be a problem. In an area where exposure to contaminants is continuous, special enclosures are available that are designed to withstand the elements, but they come with some inconvenience such as special mating parts or caps that must be opened or removed for use. In areas where the possibility of exposure to contaminants is intermittent or only remotely, possible, the additional cost and inconvenience of the special enclosures makes them prohibitive.

What is needed is a device or devices that can be used with standard enclosures to improve their ability to withstand the environmental conditions without the use of special mating devices or caps and their attendant cost and inconvenience. An example of this would be an area that is protected against the spread of fire by a sprinkler system. Activation of the sprinkler system would permit the resultant moisture to enter unprotected electrical devices, causing short circuits, grounds, personal hazards and loss of power to circuits that may be vital. Another example would be in a garage or workshop where woodworking or metalworking is performed. The buildup of sawdust or metal dust in electrical boxes can cause serious problems.

Various attempts have been made to provide weatherproof electrical junction, switch and outlet boxes and covers, particularly for use in outdoor environments.

Many prior designs purport to make electrical receptacles more-or-less weather-proof by attaching some sort of hinged cover (or covers) to the face of an outlet box, as exemplified by U.S. Pat. No. 6,982,381. In other prior devices, a slide-type connection is provided between a box and an outlet cover, so that the cover may be temporarily slid out of the way in order to make a plug connection, as exemplified in U.S. Pat. No. 5,078,614. In all such prior devices, the cover member is rigid and requires displacing the cover member in order to insert or disconnect a plug into the electrical receptacle.

In some prior devices, as exemplified by U.S. Pat. No. 4,484,021, although a plug can be inserted into the outlet without complete detachment of the device's cover, the outlet's water-resistance is compromised (often significantly) whenever the cover member is repositioned for insertion of a plug into the outlet.

In other prior devices, as exemplified by U.S. Pat. No. 5,317,108, one or more hole is provided in a cover or box member, through which can pass an electric cord that is attached to a plug, thus reportedly providing some measure of weather resistance while a plug is inserted into the electrical outlet. All such prior devices typically require that a cover be "opened" for insertion of a plug, and then that the cover be "closed" after the plug is inserted, in order to operate as designed. In most such prior devices, weather-resistance is compromised by the opening through which the electric cord passes.

In some prior devices, as exemplified by U.S. Pat. Nos. 7,097,474 and 4,424,407 and 7,097,474, the cord openings are provided with sealing-type members that reportedly form a weather resistant seal between a housing and an electric cord attached to a plug. While such prior devices may effect a weather resistant assembly, they all require that a cover be "opened" for insertion of a plug, and then that the cover be "closed" after the plug is inserted, in order to operate as designed.

It is also known in the prior art to provide various forms of boots, jackets or shrouds, which are designed to enclose a cord-and-plug that can be connected to an electrical outlet in order to provide a weather-resistant connection. U.S. Pat. No. 7,094,080, for example, discloses such a device. Such prior devices, however, generally render the outlet unprotected from moisture whenever a plug (and associated boot/jacket/shroud) is not connected to the outlet.

SUMMARY OF THE INVENTION

In view of the foregoing disadvantages inherent in the known electrical connection boxes now present in the prior art, the present invention provides a weather-resistant cover for an electrical connection box that remains operationally positioned on the face of an electrical outlet (both when there is a plug connected to the outlet as well as when no plug is connected to the outlet) to provide moisture and contaminant protection to both the interior of the outlet box and the internal contacts of the electrical receptacle.

It is an object of the present invention to provide an outlet box cover of the character described that can be immovably attached to an outlet box, and wherein the cover may remain immovably attached to said outlet box before, during and after the plugging in of an electrical cord to the electrical receptacle.

It is another object to provide a device of the character described in which the moisture- and contaminant-resistance of the outlet box is not compromised by insertion of an electric plug into the electrical receptacle.

It is another object to provide a device of the character described in which a water-proof resilient material substantially seals the outlet box and covers the face of an electric receptacle, and wherein thin slots are provided in the resilient material through which the prongs of an electric plug can be inserted into the electric receptacle.

It is another object to provide a device of the character described in which removal of the prongs of an electric plug from the receptacle causes the thin slots in the resilient material close due to the elastic memory of the resilient material.

It is another object to provide a device of the character described wherein a moisture resistant seal is effected between the prongs of an electric plug and the cover (rather than between the cord of an electric plug and the cover) when an electric plug is inserted into the electrical receptacle.

It is another object to provide an embodiment of a cover of the character described that is adapted for use on flush-mounted electrical outlet boxes.

It is another object to provide an embodiment of a cover of the character described that is adapted for use on surface-mounted electrical outlet boxes.

In these respects, the outlet box cover device according to the present invention substantially departs from the conventional concepts and designs of the prior art.

These, together with other objects of the invention, along with the various features of novelty that characterize the invention, are pointed out with particularity in the claims annexed to and forming a part of this disclosures. For a better understanding of the invention, its operating advantages and the specific objects attained by its uses, reference should be made to the accompanying drawings and descriptive matter in which there are illustrated a preferred embodiment of the invention and a variation thereof.

BRIEF DESCRIPTION OF THE DRAWINGS

The invention will be better understood and objects other than those set forth above will become apparent when consideration is given to the following detailed description thereof. Such description makes reference to the annexed drawings, wherein.

REFERENCE NUMERALS IN DRAWINGS

Figure 1:
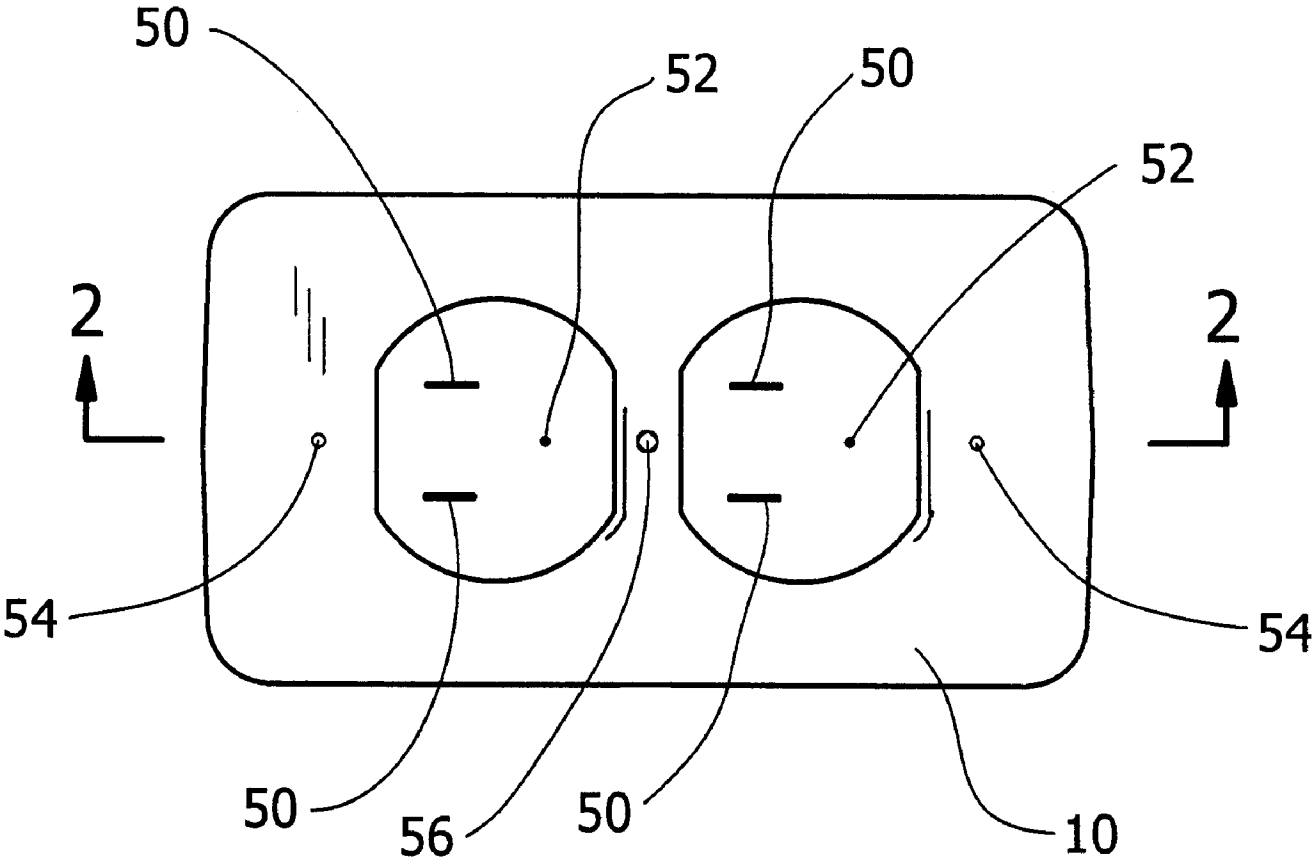
FIG. 1 is a front elevation view of a cover constructed in accordance with the present invention.

10 Cover, generally
10*a* Front surface, cover
10*b* Back surface, cover
11 Modified Cover, generally
12 Electrical box assembly
14 Housing
16 Electrical receptacle
18 Face plate
20 Screw Fastener, flange
22 Interior compartment, housing
24 Threaded hole, housing flange
26 Side wall, housing
28 Back, housing
30 Flange, housing
32 Cutout, housing
34 Flange, receptacle
36 Face, outlet
38 Opening, face plate
40 Screw Fastener, central
42 Female threaded opening, outlet
44 Prong Opening, receptacle
46 Side wall, cover
48 Outlet face, Cover portion
50 Slit
52 Pierced Opening, cover
54 Screw Hole, cover side
56 Screw Hole, cover center
58 Recess, cover

DESCRIPTION OF THE PREFERRED EMBODIMENT

An electrical outlet box cover (generally indicated as 10 in the drawing figures) constructed in accordance with the present invention is preferably made of a water-proof, electrically-insulating, resilient material, such as, but not limited to, silicone rubber.

A preferred exemplary embodiment of the invention is illustrated in drawing FIGS. 1-5 and FIG. 7 and described below in which a weather-resistant cover 10 is incorporated with a surface-mounted electrical outlet box assembly 12 comprising a housing 14, a duplex electrical receptacle 16, a face plate 18 and screw fasteners 20, 40 to provide moisture and/or airborne contaminant protection to both the housing interior compartment 22 and the internal prong contacts (not shown) of the electrical receptacle 16. However, it should be understood that the present invention contemplates means for rendering various other types of electrical connection boxes weather-resistant, and specifically is not limited to use with duplex receptacles or surface-mounted connection boxes or boxes that are rectangular shaped.

Figure 4:
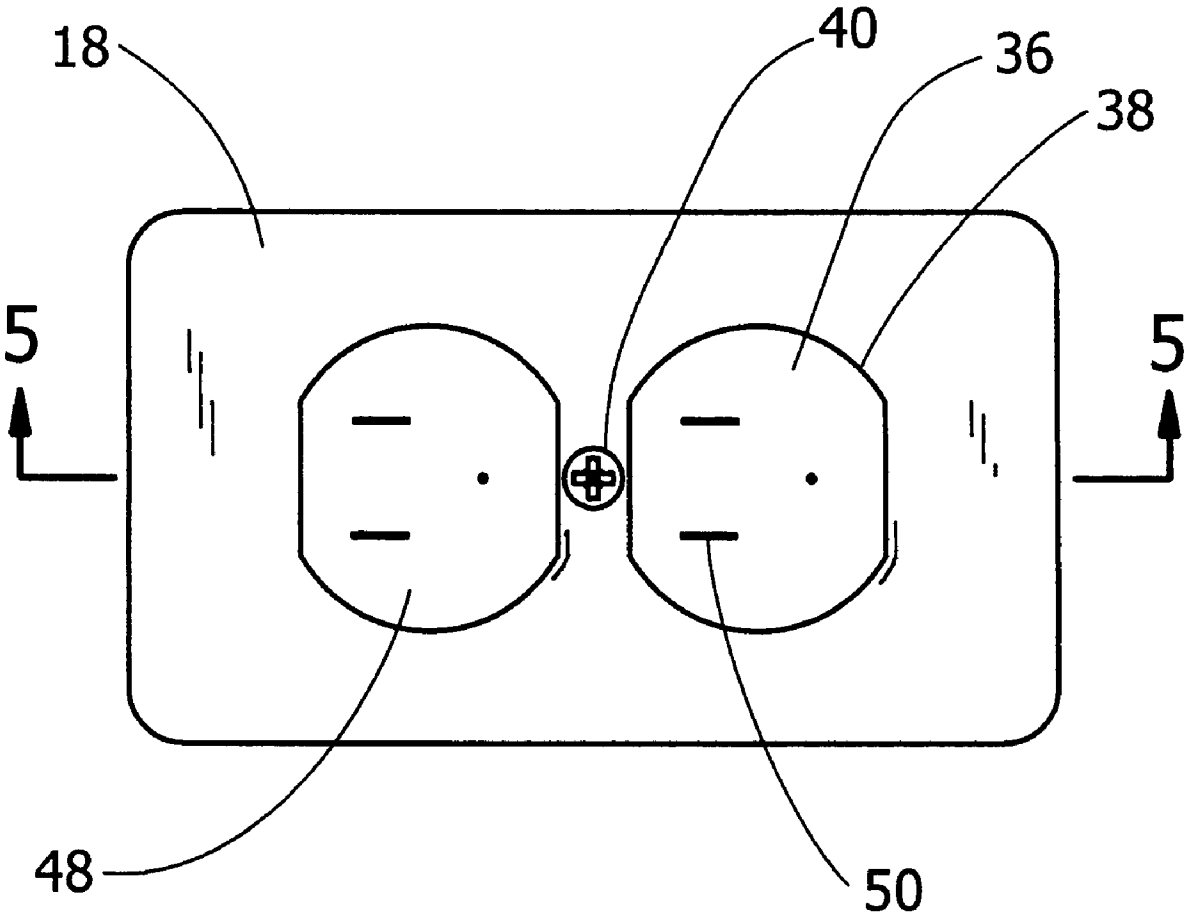
FIG. 4 is a front elevation view showing a cover-and-box assembly constructed in accordance with the present invention.
Figure 5:
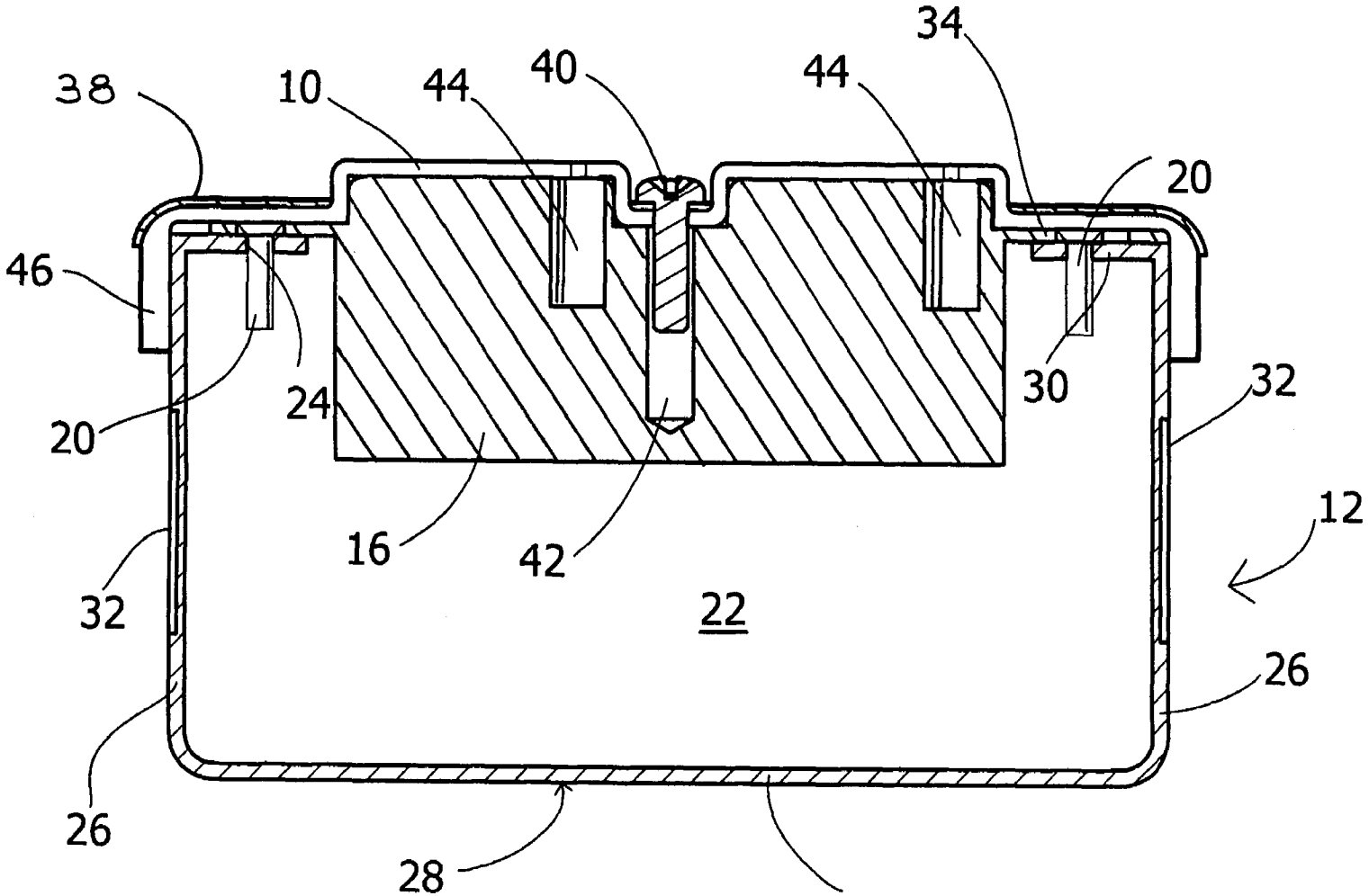
FIG. 5 is a cross-sectional view taken along the line 5-5 of FIG. 4, showing a cover-and-box assembly constructed in accordance with the present invention.
Figure 6:
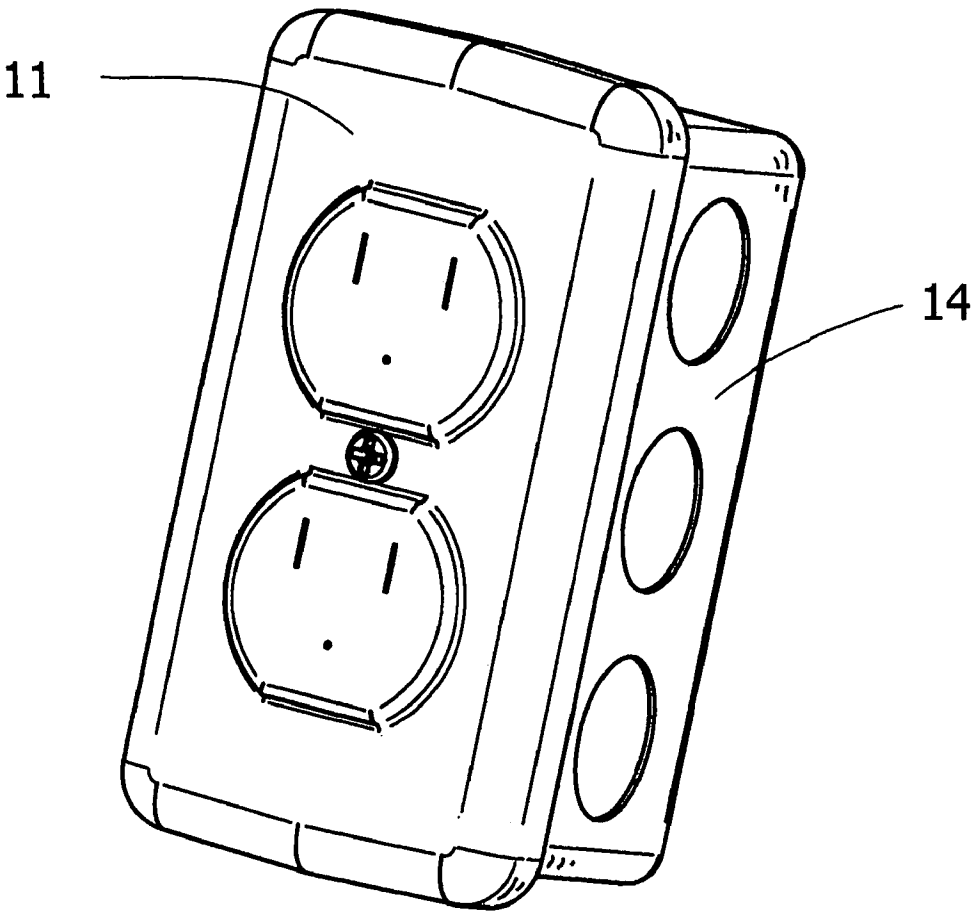
FIG. 6 is a perspective view showing a modified cover-and-box assembly constructed in accordance with the present invention; and, FIG. 7 is a perspective view showing a cover-and-box assembly constructed in accordance with a preferred embodiment of the present invention.

Referring now to FIGS. 4 and 5: Housing 14 has a back 28 and four sidewalls 26. Sidewalls 26 define a generally rectangular opening on the front side of the housing 14. Housing flanges 30, extending from sidewalls 26, are provided on the front of housing 14. Screw fasteners 20, which are engaged with threaded holes 24 in housing flanges 30, are used to secure electrical receptacle 16 to housing 14 (and may additionally secure face plate 18 to housing 14), as illustrated in FIGS. 4 and 5. Cutouts 32 are provided in the housing back 28 and/or sidewalls 26 for connection of electrical power lines (not shown) to receptacle 16 in standard fashion, as illustrated in FIGS. 5 and 6.

Common duplex electrical receptacle 16 comprises a pair receptacle flanges 34, which are used (in conjunction with screw fasteners 20) to secure receptacle 16 to housing 14; and a pair of spaced-apart outlet faces 36, each of which protrudes forward of receptacle flanges 34 through corresponding openings 38 in face plate 18; and a centrally located female threaded opening 42 for receiving a screw fastener 40, which holds face plate 18 to receptacle 16. In the preferred embodiment of the invention, outlet faces 36 protrude forward of face plate 18.

Each outlet face 36 has a plurality of plug prong openings 44, sized and configured in a pattern in accordance with standard practice to receive prongs of common electrical plugs. Each plug prong opening 44 in outlet face 36 leads to an electrical contact (not shown) within the receptacle's interior.

Referring now to FIGS. 1-5 and FIG. 7: Cover 10 is preferably molded from a single continuous material. In the preferred embodiment of the invention, cover 10 is generally rectangular shaped so as to conform to the generally rectangular shape formed by the outside of sidewalls 26 at the front of housing 14. Cover 10 has a nominally flat front surface 10*a*, a nominally flat back surface 10*b*, and a closed side wall 46 surrounding the back surface 10*b* of the cover 10.

Figure 2:
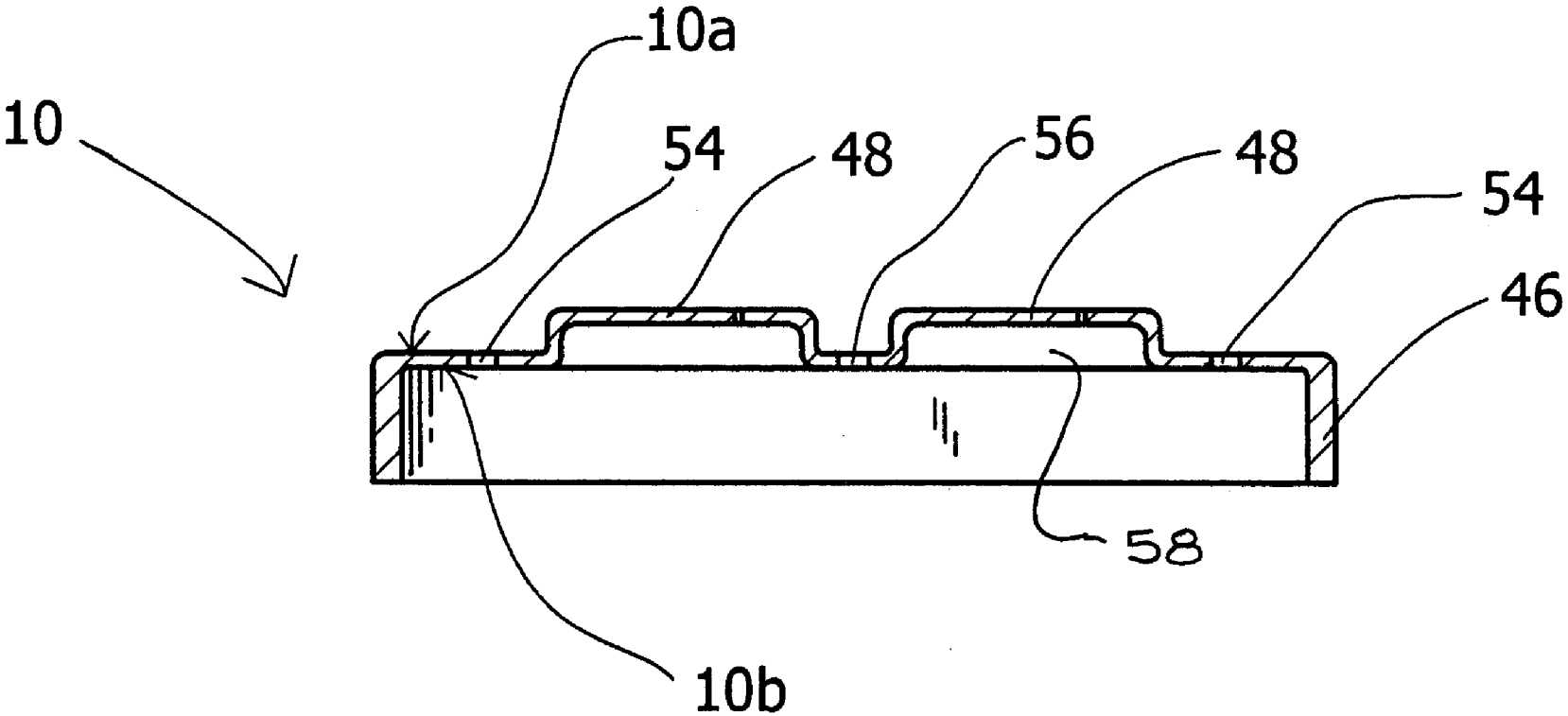
FIG. 2 is a cross-sectional view taken along the line 2-2 of FIG. 1, showing a cover constructed in accordance with the present invention.
Figure 3:
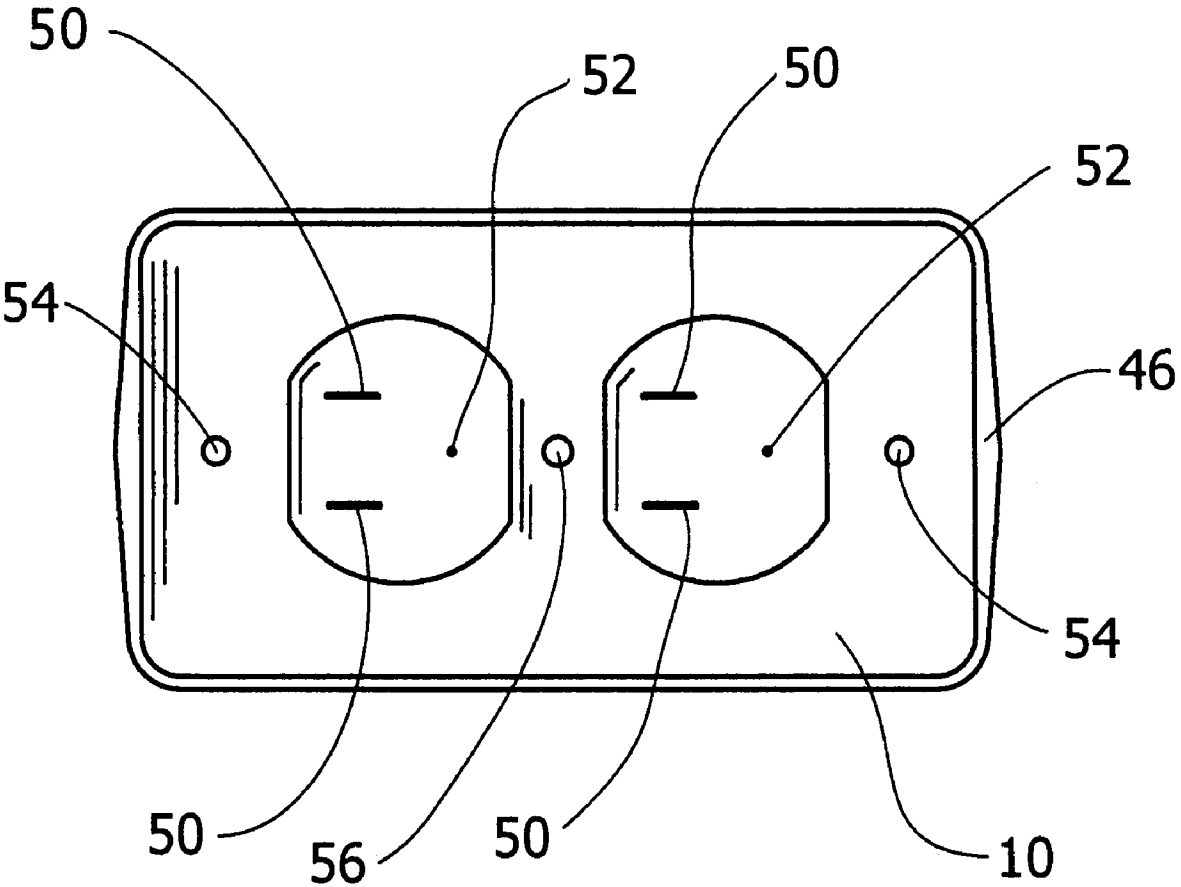
FIG. 3 is a back elevation view of the cover shown in FIG. 1.

Two outlet face cover portions 48 protrude forward of front surface 10*a*, forming a pair of outlet face cover recesses 58 on the back side of cover 10, as illustrated in FIG. 2. Each outlet face cover recess 58 is preferably positioned, sized and shaped to align with corresponding receptacle outlet face 36.

In the preferred embodiment of the invention, cover 10 is sandwiched between face plate 18 and electrical receptacle 16, as illustrated in FIG. 5. Outlet faces 36 are nested inside of respective outlet face cover recesses 58; and outlet face cover portions 48 protrude through respective face plate openings 38.

Cover side wall 46 partially extends over, and is in direct contact with, housing side wall 26, as illustrated in FIG. 5. The inside dimensions of cover side wall 46 are preferably approximately the same as the outside dimensions of the housing side walls 26, such that cover side wall 46 snugly fits onto housing 14.

Holes 54 and/or 56 may be provided in cover 10 for screw fasteners 20 and/or 40.

Figure 7:
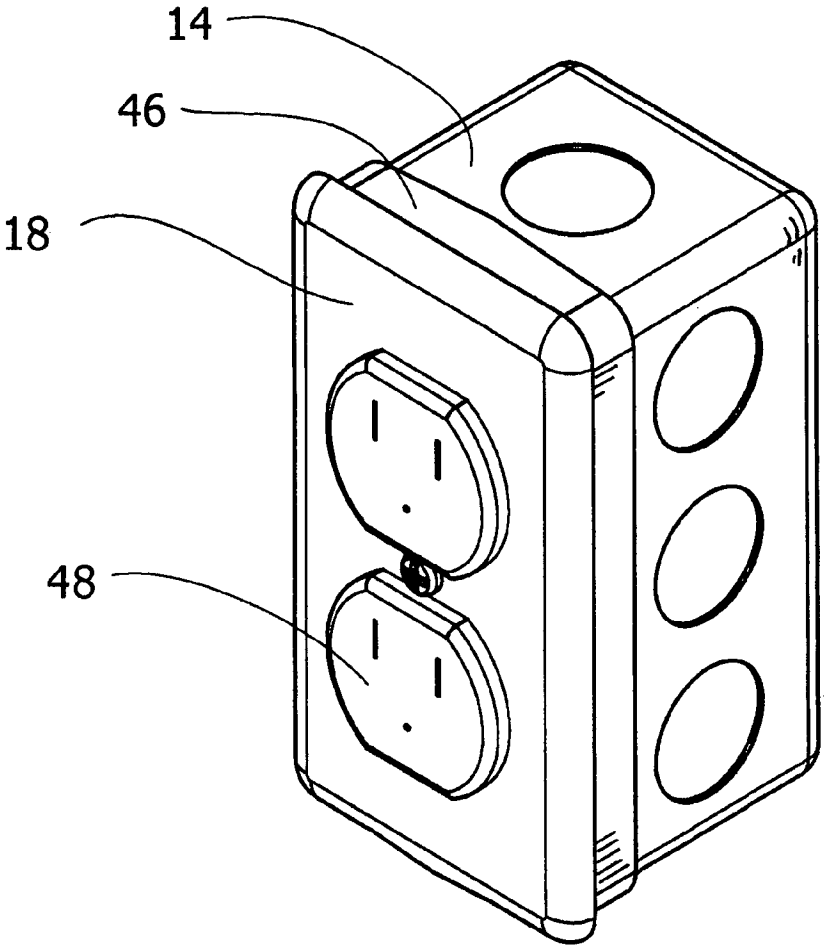

Referring to FIG. 5 and FIG. 7: As screw fastener 40 is tightened, face plate 18 is drawn toward housing 14 and electric receptacle 16, compressing cover 10 and effectively sealing interior compartment 22 from the exterior environment.

Narrow, self-closing slits 50 are cut into outlet face cover portion 48 in alignment with prong openings 44 in receptacle 16. Self-closing slits 50 are preferably approximately the same length as the length of prong openings 44, such that the prongs of an electrical cord attached to an electrical appliance can be operationally inserted through slits 50 and into prong openings 44 in receptacle 16.

The thickness of outlet face cover portion 48 is relatively thin, preferably no more than 3/32-inch thick in its uncompressed state, thus affording sufficient depth of insertion of a standard plug's prongs into the electrical receptacle 16.

In operation, the face of a plug of an electric cord, when inserted fully into receptacle 16, makes positive contact with the elastomeric cover material, thereby creating a seal between the face of the plug and the elastomeric cover. When the plug is removed, the elastic memory of the resilient material from which the cover 10 is constructed causes the slits 50 to close, thereby resealing the outlet face cover portion 48 of the device.

It will be appreciated from a review of the above description that the present invention provides means for electrical boxes to withstand adverse environmental conditions such as moisture, dust, airborne particles, rain and direct impingement of water.

It will also be appreciated by those skilled in the art that the above described weather-resistant cover can be used, for example, in conjunction with common electrical outlet box assemblies, without requiring significant modification of the assemblies' components. It will also be understood that, in the event that the described weather-resistant cover becomes damaged or worn out, it is a simple matter to remove the cover 10 (by removing screw fasteners 20, 40), and replace it with a new cover.

The above description of the preferred embodiment of the invention illustrates the use of a relatively thing, elastomeric cover member to seal an electrical connection box, wherein self-sealing "slits" (50) in the elastomeric cover allow a moveable member to extend from the exterior of the device into the interior of the device, while a seal is maintained around the moveable member. In the embodiment illustrated, the "electrical connection box" is an outlet box, and the "moveable member" is plug prong from connected to an electric cord. I should be appreciated however, that various other "electrical connection boxes" (such as an electrical switch box) and "moveable members (such as a switch toggle handle) can be employed in modified embodiments of the invention.

As will be appreciated from a review of the above description, the present invention provides one or more self-sealing "slits" (50) in an elastomeric cover 10. As used herein, the term "slit" refers to an narrow cut in the elastomeric member that extends between opposite faces of the elastomeric member. The present invention contemplates that a "slit" can be either elongated and linear (for example slit 50) so as to accommodate substantially flat plug prongs, or can be a straight piercing (for example at slit 52) so as to accommodate a plug prong having, for example, a substantially circular cross-section.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Although the description above contains many specificities, these should not be construed as limiting the scope of the invention but as merely providing illustrations of some of the presently preferred embodiments of this invention. For example:

- The elastomeric cover can be configured to fit over the outside of the face plate, overlapping the joint between the face plate and the housing box (as illustrated in FIG. 6); or, alternatively, the elastomeric cover can be configured to fit between the face plate and the housing box (as illustrated in FIG. 7);
- The housing box may hold electrical components other than an electrical receptacle, including, for example, but not limited to, an electric switch; and fittings from such components (for example a switch toggle fitting) can protrude through the cover to permit operation of such fittings;
- The elastomeric cover can be integrally molded to a face plate of the housing box;
- The elastomeric cover can be readily configured to conform to flush-mounted as well as surface-mounted electrical boxes;
- Means for sealing between the face plate and the housing on surface-mounted boxes may additionally comprise nylon cable ties or tape to improve the sealing capability and prolong the useful life of the device;
- The number, size and location of the slits can be varied as necessary to correspond to the number, size and location of the prongs that the receptacle, itself, is adapted to receive;
- The style of receptacle can vary to include "twist-lock" and other common receptacle types;
- The screw fasteners 20 that secure the receptacle to the housing 14 need not additionally secure the face plate 18 to the housing; rather, a single centrally located screw fastener 40 can be used to hold the face plate 18 and the cover 10 to the receptacle 16;
- The shape of the cover may be other than rectangular, provided the shape of the cover, specifically the shape of the perimeter of the cover, conforms to the shape of the electrical box with which it is to be used;

The cover can be made of thinner material adjacent the outlet faces than elsewhere;

For use with a flush-mounted electrical box assembly, the cover can be constructed without cover sidewalls;

Thus the scope of the invention should be determined by the appended claims and their legal equivalents, rather than by the examples given.

I claim:

1. A device for rendering an electrical outlet box moisture resistant, said box having a front and a back and an interior compartment therebetween and an electrical receptacle member disposed at least partially within said interior compartment, said electrical receptacle having an outlet face and having at least two spaced-apart prong openings in said outlet face for receiving prongs of an electrical connector plug, and said interior compartment being at least partially surrounded by a closed wall structure, and a closed perimeter of said closed wall structure defining an outlet box profile, and a compartment opening in said front of said box leading from the box exterior to said interior compartment, said device comprising:

a cover member comprising an elastomeric material;

said cover member having a front surface and a back surface and a cover perimeter;

said back surface of said cover member having a first area within said cover perimeter that is sufficiently large to cover said compartment opening in said front of said box;

and first and second self-closing slits in said cover member, each of said slits extending from said front surface of said cover member to said back surface of said cover member;

wherein said first and second self-closing slits are spaced apart at a distance equal to the distance between said at least two spaced-apart prong openings in said receptacle;

and further comprising a recessed second area portion in said back surface of said cover member;

said recessed second area portion in said back surface of said cover member being adapted to receive said outlet face;

and wherein said first and second self-closing slits in said cover member each extends from said front surface of said cover member to said recessed second area portion in said back surface of said cover member;

and wherein said cover member has a cover member thickness measurable between said front surface and said back surface of said cover member;

and said cover member has a cover member breadth measurable between opposite sides of said cover member;

and wherein said cover member thickness is thin relative to said cover member breadth;

and wherein the shape of said cover perimeter is substantially geometrically similar to the shape of said outlet box profile;

and further comprising a raised third area portion in said front surface of said cover member;

and wherein said first and second self-closing slits in said cover member each extends from said raised third area portion in said front surface of said cover member to said recessed second area portion in said back surface of said cover member;

and wherein said cover member further comprises a first hole in said cover extending from said front surface of said cover member to said back surface of said cover member;

and further comprising attachment means for attaching said cover to said electrical outlet box;

wherein said attachment means comprises a threaded fastener passing through said first hole;

and wherein said attachment means further comprises an electrical box cover plate adjacent said front surface of said cover member;

said cover plate having a first cover plate hole passing from a front face of said cover plate to a back face of said cover plate;

said first cover plate hole being alignable with said first hole in said cover member;

and said cover plate having a second cover plate hole, said second cover plate hole being adapted to receive said raised third area portion in said cover member when said first hole in said cover member is aligned with said first cover plate hole in said cover plate.

2. The device according to claim 1, wherein said cover member further comprises a continuous cover sidewall along said cover perimeter, and said continuous cover sidewall extends rearwardly from said back surface of said cover member.

* * * * *